US007382140B2

(12) United States Patent
Obrecht

(10) Patent No.: US 7,382,140 B2
(45) Date of Patent: Jun. 3, 2008

(54) METHOD AND DEVICE FOR FLAME MONITORING

(75) Inventor: Klaus Obrecht, Baden-Baden (DE)

(73) Assignee: Siemens Building Technologies HVAC Products GmbH, Rastatt (DE)

( * ) Notice: Subject to any disclaimer, the term of this patent is extended or adjusted under 35 U.S.C. 154(b) by 0 days.

(21) Appl. No.: 11/429,285

(22) Filed: May 8, 2006

(65) Prior Publication Data

US 2007/0019361 A1 Jan. 25, 2007

(30) Foreign Application Priority Data

May 6, 2005 (EP) ..... 05009937

(51) Int. Cl.
*G01R 27/26* (2006.01)
*G08B 17/12* (2006.01)

(52) U.S. Cl. ..... 324/678; 340/578

(58) Field of Classification Search ..... 324/678, 324/676, 658, 649, 60, 648, 600; 340/577, 340/578, 628, 630; 250/554; 431/69, 79
See application file for complete search history.

(56) References Cited

U.S. PATENT DOCUMENTS 4,538,137 A * 8/1985 Kimura ..... 340/512
4,591,725 A * 5/1986 Bryant ..... 250/554
4,672,324 A * 6/1987 van Kampen ..... 307/653
4,675,661 A * 6/1987 Ishii ..... 340/630
6,099,295 A * 8/2000 McCoy et al. ..... 431/79
6,346,712 B1 * 2/2002 Popovic et al. ..... 250/554
6,486,486 B1 * 11/2002 Haupenthal ..... 250/554
6,501,383 B1 * 12/2002 Haupenthal ..... 340/578
7,202,794 B2 * 4/2007 Huseynov et al. ..... 340/578
7,221,260 B2 * 5/2007 Berezowski et al. ... 340/286.05
7,224,284 B2 * 5/2007 Mi et al. ..... 340/630
7,242,310 B2 * 7/2007 Hotton et al. ..... 340/632
7,289,032 B2 * 10/2007 Seguin et al. ..... 340/578
2007/0290868 A1 * 12/2007 Manning ..... 340/578

FOREIGN PATENT DOCUMENTS

DE 102 47 168 A1 4/2004
EP 0 617 234 A 9/1994
EP 0 908 679 A 4/1999
EP 0 953 805 A 11/1999

OTHER PUBLICATIONS

Patent Abstracts of Japan, Bd. 012, Nr. 134 (M-689), Apr. 23, 1988—& JP 62 255729 A (Matsushita Electric Ind Co Ltd), Nov. 7, 1987.

* cited by examiner

*Primary Examiner*—Andrew H. Hirshfeld
*Assistant Examiner*—Hoai-An D. Nguyen
(74) *Attorney, Agent, or Firm*—Staas & Halsey LLP

(57) ABSTRACT

A capacitor connected to a voltage source is charged during a charging phase up to a voltage value, and during a discharging phase the capacitor is discharged via a coupling element connected to the flame sensor. The period for the charging or discharging phase of the capacitor respectively is selected in this case as a function of the characteristics of the flame sensor, especially of its impedance. For flame monitoring the charging and discharging of the capacitor is repeated cyclically, with the voltage signal obtained in this way being evaluated in single-channel mode with the aid of a threshold value.

5 Claims, 4 Drawing Sheets

METHOD AND DEVICE FOR FLAME MONITORING

CROSS REFERENCE TO RELATED APPLICATIONS

This application is based on and hereby claims priority to European Application No. EP05009937 filed on May 6, 2005, the contents of which are hereby incorporated by reference.

BACKGROUND OF THE INVENTION

The invention relates to a method and a device for flame monitoring.

A method and a device of the type mentioned at the start is known for example from EP 617 234 910 A1. This publication discloses an ionization flame detector with a capacitor, which is connected to a reference voltage source and via a coupling element to the secondary circuit of a firing circuit. For as long as there is no flame present between the firing electrode and the ground lead the capacitor is charged via a resistor to an operating voltage. As soon as an ionization stream flows as a result of flame generation the capacitor is discharged. The capacitor is connected to a monitoring circuit which, if a predetermined threshold value is exceeded, creates an output signal which indicates the presence of a flame.

EP 1 256 763 A2 discloses a flame monitoring method, in which the radiation created by the flame is recorded by a photoresistor and the sensor signal is evaluated on two channels. The first channel is used to record the average brightness and the second channel is used to record changing components which emanate from flickering of the flame. The flame is only recognized as burning correctly if the signal is within a predetermined range in each case at both channel outputs.

SUMMARY OF THE INVENTION

One possible object of the invention is to propose a method or a device respectively for flame monitoring, which has a wide diversity of uses and allows simple signal evaluation.

The inventor proposes a method in which a capacitor connected to a voltage source is charged during a charging phase up to a voltage value and during a discharging phase the capacitor is discharged via a coupling element connected with the flame sensor. The period for the charging and discharging phase of the capacitor is selected in this case as a function of the characteristics of the flame sensor, especially of its impedance. The charging or respectively discharging of the capacitor is repeated cyclically and the voltage signal thus obtained is subject to single-channel evaluation for flame monitoring.

Uniform threshold values are preferably used for different sensor impedances.

The method and device enable different flames, e.g. pilot flames or flames at maximum load of an oil, gas or solid fuel burner to be monitored, with a plurality of different flame sensors, e.g. photoresistor, ionization current electrode, UV tubes, etc. being able to be used for flame monitoring.

The method and device do not need any active signal amplification to evaluate the signals. This allows the monitoring circuit to be constructed with a small number of components. For example the capacitor provided for flame monitoring also assumes the function a signal filter with lowpass characteristics.

The method can be used in permanent or in intermittent operation of a burner, with different error scenarios able to be taken into account for signal evaluation. For example the impedance of the flame sensor can assume a static value in the event of an error or when exposed to daylight. This can be detected at the end of the charging phase by evaluating the voltage signal obtained at the capacitor. Component faults of the circuit or of the sensor, for example a short circuit of the flame sensor or an interruption in the line to the flame sensor can also be identified.

Foreign light can also be detected by the method. If the flame sensor is exposed to a fluorescent lamp or an incandescent bulb, this changes the impedance of the flame sensor in the rhythm of the mains frequency or of its multiple. The mains harmonic changes of the sensor impedance caused by the foreign light source do not lead with a mains-synchronous evaluation of the voltage signal to any signal dynamic. For detection of foreign light in continuous operation, the flicker component of the flame, which for example lies in the frequency range of 8-30 Hertz, can be monitored and evaluated.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENT

Figure 1:
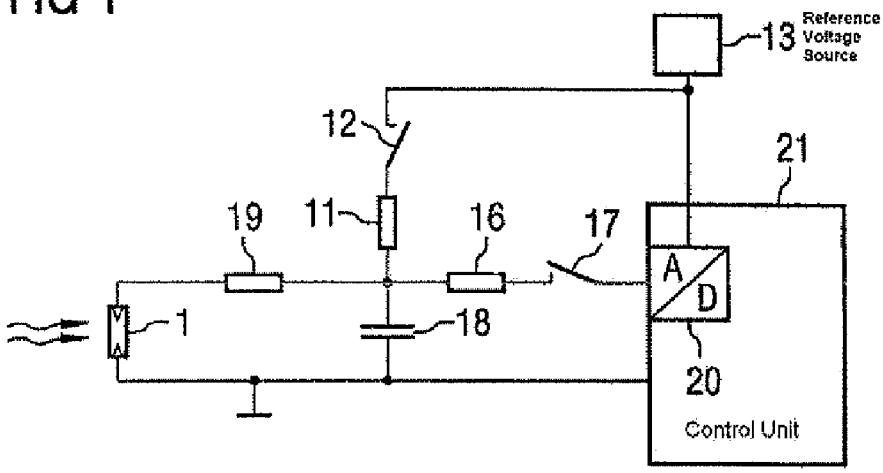
FIG. 1 a basic block diagram of a monitoring circuit

Reference will now be made in detail to the preferred embodiments of the present invention, examples of which are illustrated in the accompanying drawings, wherein like reference numerals refer to like elements throughout.

FIG. 1 shows the basic structure of a circuit for flame monitoring according to one potential embodiment of the invention. With slight modification, the circuit can be adapted to different flame sensors for recording the flame formation and flame existence of oil, gas and solid fuel burners.

The flame sensor is for example a photoresistor 1 which exhibits a radiation sensitivity in the spectral range to be monitored. The radiation sensitivity is expressed by different impedance values on irradiation of the flame sensor, with an increase in the intensity of the flame radiation resulting in a decrease in the impedance value of the photoresistor.

The photoresistor 1 is connected via a coupling element 19 to a capacitor 18 provided for evaluation. The capacitor 18 is connected via a switch 12 with a reference voltage source 13 which has an internal resistance 11.

For charging, the capacitor 18 is connected via the internal resistance 11 by the switch 12 to the reference voltage source 13. This charges up the capacitor 18 to a voltage value which is dependent on the internal resistance 11 of the reference voltage 13, the impedance of the coupling element 19 and of the photoresistor 1. After a defined charging time a measured value dependent on the impedance of the flame sensor 1 is obtained by an A/D converter 20. The A/D converter 20 can be connected via a switch 17 and a resistor 16 to the capacitor 18. The A/D converter 20 can however also be connected directly to the capacitor 18. The switches 12 and 17 can be field effect transistors for example.

In the discharging phase the connection to the reference voltage source 13 is interrupted by the switch 12 and the capacitor 18 is discharged via the coupling impedance 19 through the photo resistor 1. After a defined discharging time the A/D converter 20 delivers a measured value dependent on the impedance of the flame sensor 1 filtered through the capacitor 18. The charging and/or discharging phase is controlled by a control unit 21, which is embodied for example as a microprocessor or logic component with a comparator.

Figure 2:
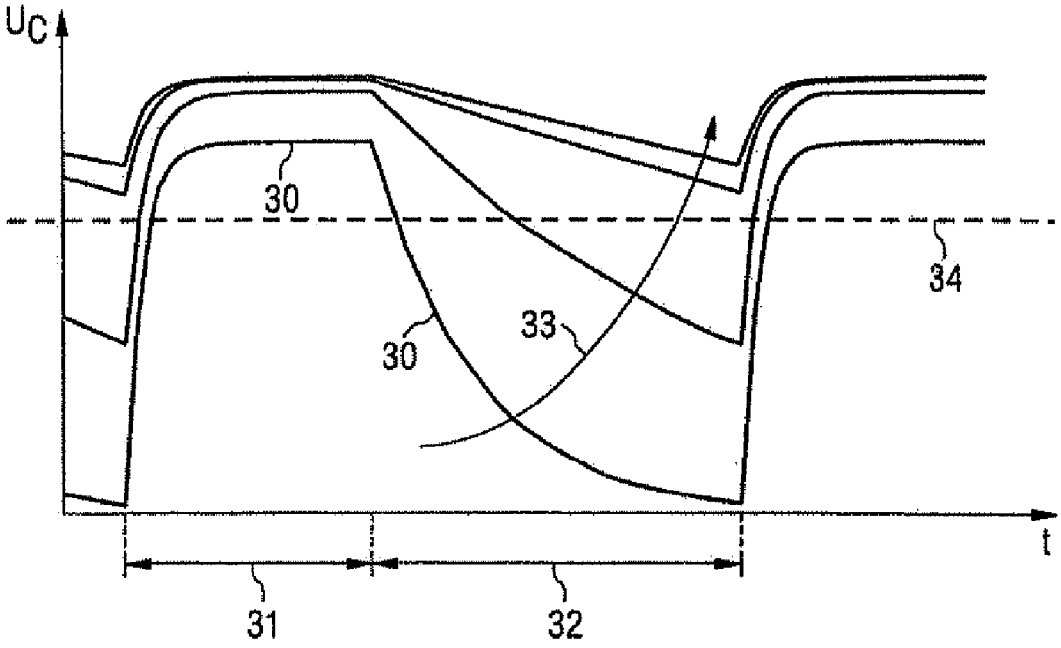
FIG. 2 voltage signal waveform as a function of the sensor impedance

FIG. 2 shows the signal waveform for the voltage Uc obtained at the capacitor as a function of the impedance of the flame sensor and the time. The increase in the impedance is shown by an arrow 33. As the impedance increases the voltage Uc obtained at the end of the charging phase 31 or of the discharging phase 32 at the capacitor assumes a higher value. A voltage signal 30 characteristic for the relevant sensor impedance, which is evaluated for flame monitoring, is obtained by a cyclic repetition of the charging or discharging phase respectively. A uniform threshold value 34 is preferably used for evaluation of the sensor impedance-dependent voltage signal 30. The threshold value 34 and the period for the charging or discharging phase respectively can be defined by a control unit. The period for the charging or discharging phase respectively is selected in this case as a function of the relevant impedance or characteristics of the flame sensor. An evaluation of the voltage signal 30 at the end of the charging phase 31 and/or at the end of the discharging phase 32 enables component faults in the monitoring circuit or faults in the flame sensor to be detected.

Figure 3:
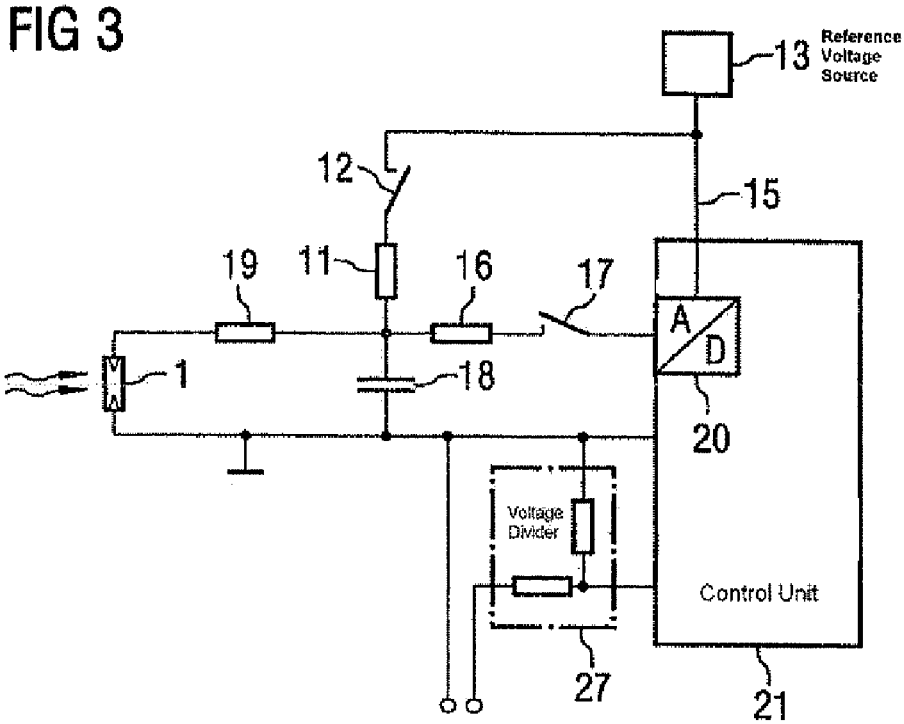
FIG. 3 a further development of the circuit for detection of foreign light shown in FIG. 1

FIG. 3 shows a development of the monitoring circuit shown in FIG. 1 which additionally features a voltage divider 27 which is used for feedback of the mains phase to the control unit 21. The voltage at the capacitor 18 is recorded synchronously to the mains frequency in this way. The charging phase in this case is preferably selected to be long enough for the switch 12 to remain closed for at least one mains period after the charging of the capacitor 18 During this period the monitoring of the network phase and the closing of the switch 17 enables the voltage obtained at the capacitor 18 to be recorded by the A/D converter 20 cyclically and synchronously to the network frequency. If the flame sensor is irradiated for example by a fluorescent lamp, the sensor impedance is changed by this in the rhythm of the mains frequency or in its multiple.

Figure 4:
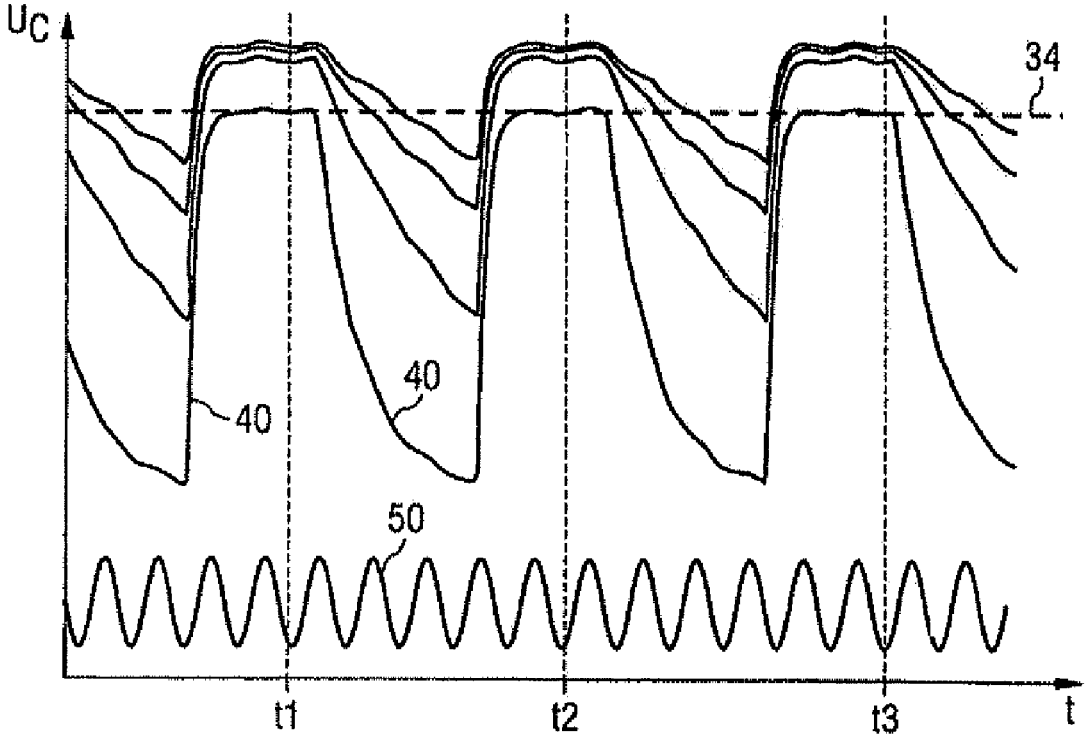
FIG. 4 voltage signal waveform with foreign light signal

FIG. 4 shows the voltage Uc obtained at the capacitor together with a mains-synchronous foreign light signal 50 as a function of the time. A characteristic voltage signal 40 for the relevant sensor impedance is obtained by the cyclic repetition of the charge or discharge phase respectively, which can be recorded and evaluated synchronously with the mains at the times t1, t2, t3, etc. In this case the same voltage values Uc are obtained in this exemplary embodiment for one and same sensor impedance. An average value can for example be formed from these voltage values, which is evaluated for foreign light detection. If the average value lies below a defined threshold value 34 this is recognized as a foreign light error.

Figure 5:
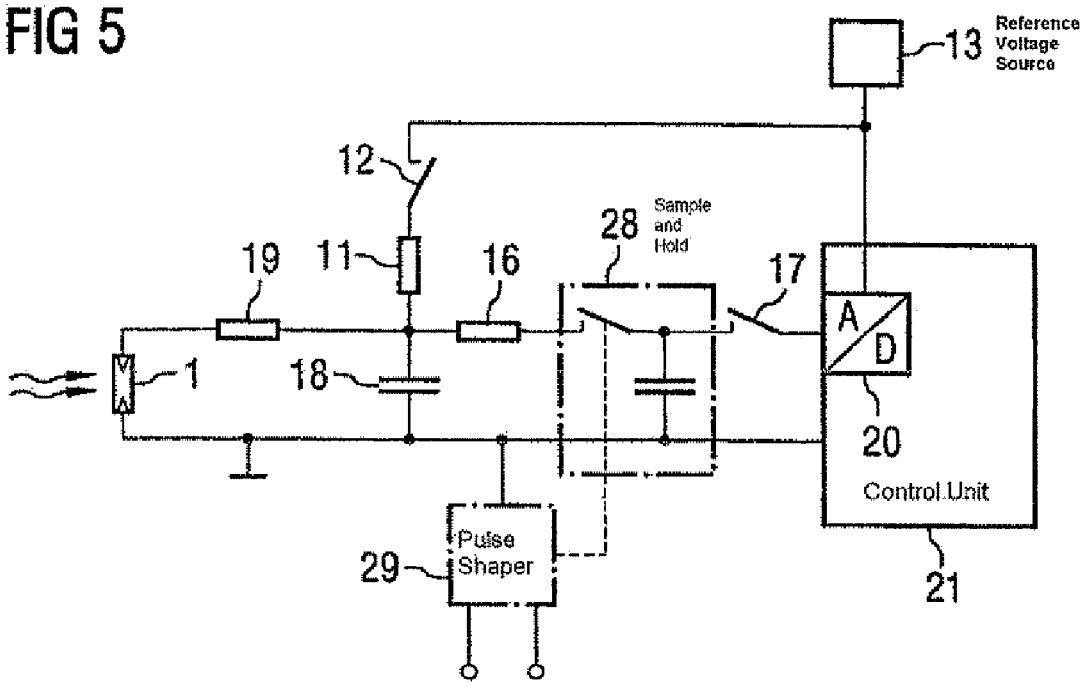
FIGS. 5 to 8 show further embodiments of the monitoring circuit

FIG. 5 shows a circuit for which sampling can be undertaken at random times. The sampling values delivered by a sample-and-hold element 28 synchronously to the mains frequency of stored in this case in a capacitor 30. A pulse shaper stage 29 generates a control pulse from the mains frequency which closes the sample-and-hold element 28 for a short time and thereby effects a charging of the capacitor 30 with the sampling values.

Figure 6:
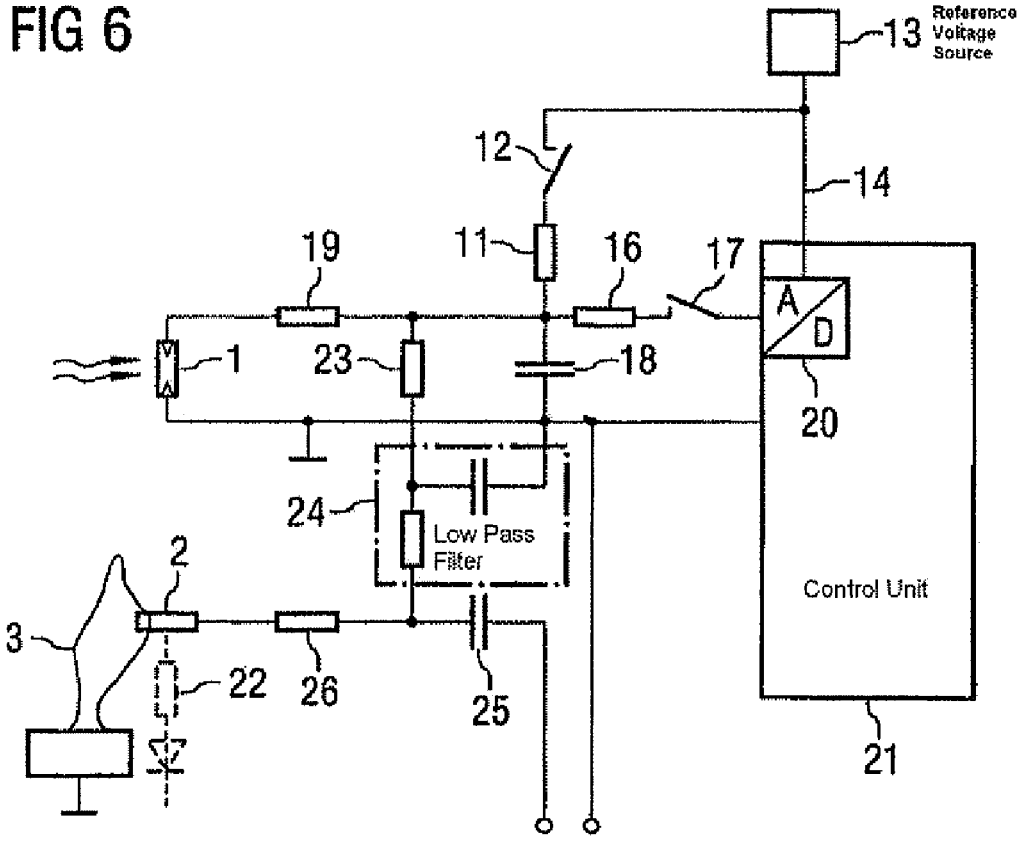

FIG. 6 shows a circuit which is used for two different flame sensors 1 and 2. With a gas flame 3 a chemical reaction takes place during combustion, whereby free ions arise. These result in the flame 3 becoming conductive and a current can flow if a voltage is applied. The ions in this case only move in the direction of the flame. If an ac voltage is applied between the burner chassis and the ionization electrode 2 the ionization causes a rectifier effect.

A series element 22 is shown by a simplified equivalent circuit for the rectifier effect by flame ionization. An ac voltage is applied to the ionization electrode 2 via a capacitor 25 and a resistor 26. The flame ionization causes a rectification of the ionization current which leads to a potential shift at the capacitor 25. The charge shift is coupled in from the capacitor 25 to the capacity 18 via a coupling resistor 23 and a low pass filter 24. During the discharging phase that capacitor 18 is then discharged depending on the ionization current.

Figure 7:
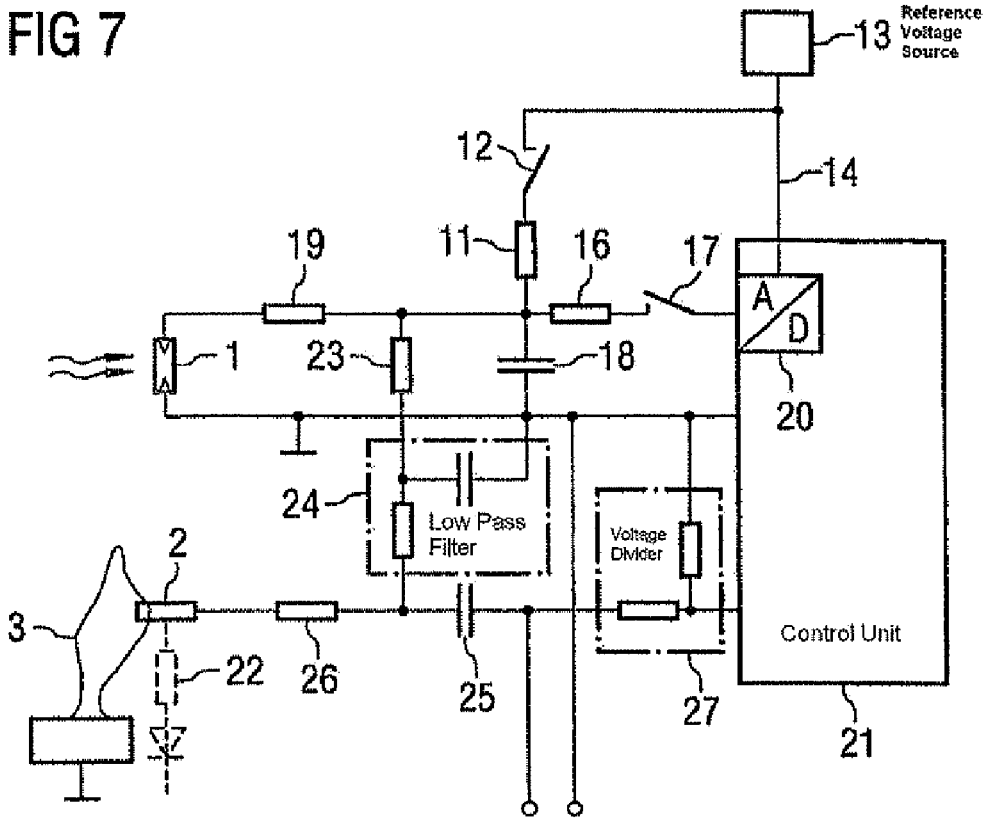

FIG. 7 shows a development of the circuit shown in FIG. 6 which additionally features a voltage divider 27 which is used for feeding back the mains phase to the control unit 21. This records the voltage at the capacitor 18 synchronously with the mains frequency. The evaluation can be undertaken in the same manner as has been described at the start in connection with a photoresistor.

Figure 8:
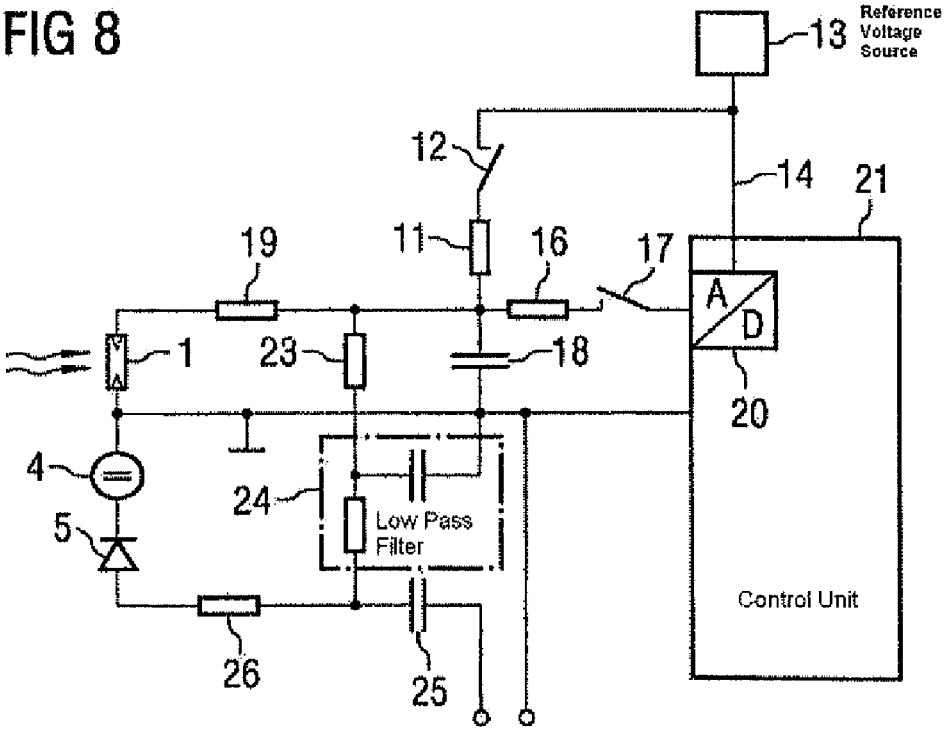

FIG. 8 shows a monitoring circuit for a UV sensor. With this circuit a pulsing voltage is applied to a UV sensor 4 via a capacitor 25, a resistor 26 and a diode 5. When irradiated with UV light conducting through the UV tubes then occurs. The cyclic firing of the UV tubes drives a pulse current through the diode 5 and leads to a potential shift at capacitor 25. The charge shift at the capacitor 25 is coupled in to the capacitor 18 via a coupling resistor 23 and a lowpass filter 24. The charge shift at the capacitor 25 polarized in this case so that this leads to a discharge of the capacitor 18 during the discharging phase. The voltage signal at the capacitor 18 for flame monitoring can be evaluated in this case in the same manner as has been described in connection with a photoresistor or ionization electrode.

The invention has been described in detail with particular reference to preferred embodiments thereof and examples, but it will be understood that variations and modifications can be effected within the spirit and scope of the invention covered by the claims which may include the phrase "at least one of A, B and C" as an alternative expression that means one or more of A, B and C may be used, contrary to the holding in *Superguide v. DIRECTV,* 69 USPQ2d 1865 (Fed. Cir. 2004).

The invention claimed is:

1. A flame monitoring device, comprising:

a control unit;

a reference voltage source supplying a reference voltage; and a capacitor connected to a reference voltage source via a switch, charged by the reference voltage during a charging phase, and discharged during a discharge phase via a coupling element connected to a flame sensor;

wherein the switch which is closed during the charging phase and opened for the discharging phase, is under control of the control unit, wherein a duration of the charging phase or the discharging phase is determined by the control unit based on an impedance of the flame sensor, and that, when initiated by the control unit for flame monitoring wherein the charging or discharging of the capacitor is repeated cyclically, a voltage signal is obtained at the capacitor, and the voltage signal is evaluated in a single-channel mode using a threshold value.

2. The device of claim 1, wherein the control unit includes an analog-digital (A/D) converter connected to the capacitor either directly or via a switch.

3. The device of claim 2, further comprising a voltage divider feeding back a phase of the utility frequency to the control unit.

4. The device of claim 3, further comprising a sample-and-hold element sampling the voltage signal synchronously with a utility frequency or with a multiple of the utility frequency.

5. The device of claim 4, further comprising a pulse shaper stage creating a control pulse based on the utility frequency for intermediate storage of the sampled values in a storage capacitor.

* * * * *